United States Patent [19]

Kedrowski et al.

[11] Patent Number: 4,743,498

[45] Date of Patent: May 10, 1988

[54] EMULSION ADHESIVE

[75] Inventors: Thomas J. Kedrowski, Vadnais Heights; Nicholas C. Lehman, Maple Grove, both of Minn.

[73] Assignee: H.B. Fuller Company, St. Paul, Minn.

[21] Appl. No.: 846,287

[22] Filed: Mar. 31, 1986

[51] Int. Cl.[4] ..... D04H 1/58

[52] U.S. Cl. ..... 428/288; 428/290

[58] Field of Search ..... 428/198, 288, 290, 360, 428/361

[56] References Cited

U.S. PATENT DOCUMENTS

| | | | |
|---|---|---|---|
| 2,837,462 | 6/1958 | Morin | 167/84 |
| 4,207,367 | 6/1980 | Baker, Jr. | 428/171 |
| 4,381,332 | 4/1983 | Fulmer et al. | 428/288 |
| 4,443,623 | 4/1984 | Photis | 560/170 |
| 4,446,280 | 5/1984 | Cady et al. | 525/186 |
| 4,454,301 | 6/1984 | Cady et al. | 525/118 |
| 4,554,337 | 11/1985 | Krinski et al. | 527/201 |

OTHER PUBLICATIONS

Du Pont Technical Bulletin, Acrylonitrile.

Untitled Technical Bulletin Regarding Glacial Methacrylic Acid and Glacial Acrylic Acid.

Untitled Technical Bulletin Regarding Properties of Vinyl Acetate.

American Cyanamid Company Technical Bulletin, Methyl Acrylamidoglycolate Methyl Ether.

FMC Corporation Technical Bulletin, Diallyl Maleate Monomer.

Pennwalt Corporation Technical Bulletin, Tertiary Dodecyl Mercaptan, dated 7-1-72

Gaf Corporation Technical Bulletin, IGEPAL CA-897.

Dow Technical Bulletin, Hydroxyalkyl Acrylates; HEA and HPA High Purity Functional Monomers for Coatings and Resins pp. 1-5.

Alcolac Technical Data Bulletin, Siponate X200, pp. 1-3.

America Inc. Chemicals Division Technical Bulletin, TWEEN 20.

American Cyanamid Company Technical Bulletin, MAGME Multi-Functional Acrylic Monomer, pp. 1-23.

American Cyanamid Company Technical Bulletin, Surfactants.

Effect of Alpha-Methyl Groups on Room Temperature Crosslinking in Acrylic Polymer Containing MAGME Monomers by Howard R. Lucas pp. 49-55.

*Primary Examiner*—James J. Bell

*Attorney, Agent, or Firm*—Merchant, Gould, Smith, Edell, Welter & Schmidt

[57] ABSTRACT

A novel adhesive comprising an aqueous emulsion of a polymer comprising a vinyl monomer and an alkylacrylamidoglycolate alkyl ether monomer. The polymer in contact with randomly laid fibers can be heat curable at elevated temperature to form an intact nonwoven fabric without the release of substantial amounts of formaldehyde.

13 Claims, No Drawings

EMULSION ADHESIVE

FIELD OF THE INVENTION

The invention relates to adhesives that cure under conditions of heat to form strong thermosetting bonds with no formaldehyde generation. More particularly the invention relates to nonwoven fabrics and to aqueous emulsion adhesives that can be used in the manufacture of nonwovens by binding one or more webs comprising loosely randomly assembled fibers.

BACKGROUND OF THE INVENTION

Thermosetting Adhesives

The emulsion adhesives of the invention comprise a heat curable thermosetting composition which can be used in the form of an aqueous polymer emulsion. The adhesive when cured, in contact with a substrate, can crosslink to form strong thermosetting bonds. Such adhesives can be used in many end uses including in the manufacture of nonwoven fabrics.

Woven fabrics are distinguishable from nonwoven fabrics since woven fabrics obtain mechanical strength and stability from manufacturing operations such as conventional weaving and knitting. Such manufacturing operations result in a generally regular or periodic interaction, interweaving or arrangement of individual fibers, threads, or yarns in a fabric. In sharp contrast, nonwoven fabrics are typically flexible or inflexible sheet-like materials produced directly by adhesively bonding fibers without conventional weaving, knitting or other typical woven fabric manufacturing operations.

Typically nonwoven fabrics are produced by adhesively bonding a loosely assembled collections of fibers which are typically laid in a random, unordered and unarranged fashion. Typically the unbonded irregular arrangement of fibers is not inherently mechanically stable in a fabric. Mechanical strength, stability and integrity of nonwoven fabrics arise from adhesive bonds between fibers.

Nonwoven fabrics are found in many end uses which require a number of unique physical properties. Nonwoven fabrics are desirably strong, heat resistant, solvent resistant, easily made, and must be resistant to a fabric failure in which the nonwoven fibers revert to the loose collection of fibrous starting materials. In order to achieve these properties, the adhesive used in conjunction with nonwoven fibers must bind the fibers into a strong, mechanically stable web or webs, must resist degradation of bond strength as a result of the presence of heat, moisture or solvents, must be easily applied and must rapidly bond the nonwoven fibers.

A number of adhesives have been proposed for nonwoven fabric manufacture including formaldehyde-containing resins, urethane adhesive resins, and acrylic polymeric resin adhesives. The most common nonwoven manufacturing adhesives comprises formaldehyde containing resins which are inexpensive, easy to use and form mechanically stable nonwoven fabrics. However such resins are typically the source of substantial quantities (about 200 to 500 ppm or more in the ambient air) of formaldehyde during curing. Formaldehyde has been identified as a hazardous substance and a great deal of attention has been focused in recent years on a substitute adhesive free of formaldhyde generation. The current limit on formaldehyde concentration in the workplace is about 3 ppm in the ambient air. Further, while the formaldehyde-containing adhesives are generally adequate for most nonwoven fabric manufacture a continued effort has been made to find improved adhesives having properties resulting in improved nonwoven materials.

The prior art has suggested using adhesives such as urethane polymers and acrylic polymers, as is shown in Van Norden Morin, U.S, Pat. No. 2,837,462, Baker, Jr., U.S. Pat. No. 4,207,367, Fulmer et al., U.S. Pat. No. 4,381,332, and others. These alternative adhesives do not appear to have achieved substantial commercial significance.

Clearly a substantial need exists for an improved thermosetting emulsion adhesive that can be used in end uses such as bonding fibers into nonwoven fabrics free of substantial formaldehyde release during cure. The preferred adhesive will provide nonwoven fabrics having high tensile strength, heat resistance, moisture and solvent resistance, and tear resistance.

BRIEF DISCUSSION OF THE INVENTION

We have found a new aqueous emulsion adhesive composition comprising a vinyl polymer having randomly polymerized residues derived from an alkylacrylamidoglycolate alkyl ether monomer. The emulsion polymer can be a copolymer containing the alkylacrylamidoglycolate alkyl ether monomer in combination with other vinyl monomers such as an alpha-olefin, a styrene monomer, a monomer with an active hydrogen, and others used for the purpose of developing other desired properties known to the skilled vinyl polymer chemist.

An aspect of the invention is a heat curable adhesive that can form strong thermosetting bonds under the influence of elevated temperature. Such adhesives can be used in the manufacture of nonwoven fabrics. In the manufacture of nonwoven fabrics the adhesive is typically applied in the form of an aqueous emulsion to a loose fiber mat. The aqueous emulsion coats the fibers in the mat and can be heat cured. The adhesive when heat cured can bond fiber to fiber to result in a mechanically stable, high quality nonwoven fabric comprising one or more webs. We have found that the alkyl acrylamidoglycolate alkyl ether monomer appears to crosslink through a reaction with other similar residues on adjacent polymer chains, through di-, tri- or poly-functional crosslinking catalysts or promoters and can crosslink with an optional crosslinking reactive hydrogen containing group an adjacent polymer chains, to form an adhesive mass of high strength and chemical and mechanical stability that bonds fiber to fiber. Since the alkyl acrylamidoglycolate alkyl ether monomer crosslinks without the formation of formaldehyde, production personnel are not exposed to the hazardous material. The other monomers in the polymer cooperate to provide (i) a stable emulsion that is easily manufactured and used, (ii) a polymer which is compatible with typical nonwoven fibers and (3) cured adhesive bonds having high heat, moisture and solvent resistance.

DETAILED DISCUSSION OF THE INVENTION

Briefly, the novel adhesive compositions of this invention comprise, in an emulsion having from about 20 to 90wt-% solids, a vinyl polymer made by polymerizing a monomer mixture comprising an alkylacrylamidoglycolate alkyl ether monomer. The monomer mixture can contain other vinyl monomers.

The alkylacrylamidoglycolate alkyl ether monomer compound that can be used in the adhesive polymer of the invention has the following general structure:

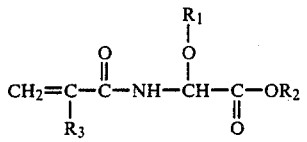

wherein $R_1$ and $R_2$ are independently selected from aliphatic or cycloaliphatic hydrocarbon groups having 1 to 6 carbon atoms and $R_3$ is selected from hydrogen or methyl. Mixtures of such monomer compounds can also be used. The preferred alkylacrylamidoglycolate alkyl ethers comprise the acrylic-methyl ester-methyl ether analog.

The alkylacrylamidoglycolate alkyl ether is an acrylic crosslinking monomer which has been developed and is disclosed for use in forming polymeric coating compositions that are typically applied as solutions in a compatible non-aqeuous solvent. The preparation of the monomer and polymers containing the crosslinking monomer for use in coatings disclosed in Photis, U.S. Pat. No. 4,443,623, Cady et al, U.S. Pat. No. 4,446,280, and Cady et al, U.S. Pat. No. 4,454,310. A paper binder composition using the alkylacrylamidoglycolate alkyl ether compound in modified protein adhesives is shown in Kriniski et al, U.S. Pat. No. 4,554,337. The alkylacrylamidoglycolate alkyl ether monomers are known to crosslink with adjacent alkylacrylamidoglycolate alkyl ether monomers or with amines or hydroxyl groups or through di, tri or polyfunctional compounds such as 1,3-propanediamine, 1,6-hexanediamine, bis(3-aminopropyl)diethylene glycol, and others to an adjacent alkylacrylamidoglycolate alkyl ether monomer residue. The preferred methylacrylamidoglycolate methyl ether is typically sold in the form of a finely divided solid which is typically either solubilized in compatible liquid monomers or is added in the solid particulate state to polymerization reactors.

The polymeric compositions present in the aqueous emulsion adhesives of this invention can contain the alkylacrylamidoglycolate alkyl ether monomer in combination with virtually any other non-formaldehyde generating vinyl monomer. Examples of the broad classes of such vinyl monomers include alpha-olefins, vinyl chloride, vinylidine chloride, vinyl aromatic monomers, polymerizable alpha, beta-unsaturated carboxylic acid compounds, monomers having a pendent group with a reactive active hydrogen, and other well known monomers.

Alpha-olefins that can be used in the invention include $C_{1-6}$ alpha-olefins such as ethylene, propylene, 1-butene, isobutylene, cyclopentene, cyclopentadiene, 1,3-butadiene, 1-hexene, norbornene, etc.

Vinyl aromatic monomers that can be used in forming the adhesive polymers of this invention include monomers that comprise at least one aromatic group and at least one polymerizable vinyl group. Typical examples of aromatic groups include phenyl, substituted phenyl, naphthyl, phenanthryl, and others. Preferred vinyl aromatic monomers include the styrene family including such monomers as styrene, methyl styrene (vinyl toluene), ethyl styrene, isopropyl styrene, tertiary butyl styrene, etc. 4-hydroxy styrene, 4-chlorostyrene, and styrene with other common ring substituents. The most preferred member of the styrene family for use in the adhesive polymers of the invention comprises styrene because of its reactivity, ease of use, and cost.

Monomers that can also be used in conjunction with the alkylacrylamidoglycolate alkyl ether monomer and the vinyl aromatic monomer in the polymers of the invention include a polymerizable alpha, beta-unsaturated carboxylic acid monomer compound. The alpha, beta-unsaturated acid monomer compound includes polymerizable olefinic acids such as acrylic acid, methacrylic acid, itaconic acid, fumeric acid, maleic acid, crotonic acid, their ester amides and other derivatives. The polymerizable acids can be used in the form of a $C_{1-10}$ alkyl ester such as methylacrylate, methyl methacrylate, ethyl methacrylate, butyl acrylate, 2-ethylhexyl acrylate, di-n-butyl maleate, cyclohexylfumerate, 2-ethylhexyl itaconate, methylethyl maleate, ditertiary butyl crotonate, and others. The adhesive polymer of the invention can contain the alpha, beta-unsaturated carboxylic acid compound, the alpha, beta-unsaturated carboxylic acid ester compound, or mixtures thereof.

The polymer of the invention can crosslink through a monomer having a pendent group with a crosslinking reactive active hydrogen. Typically such crosslinkable hydrogen is found on a hydroxyl or amino group. Typical crosslinking reactive active hydrogen containing monomers which may be incorporated into the polymer to participate in a crosslinking reaction include hydroxyalkyl acrylates and methacrylates such as hydroxyethyl methacrylate, hydroxyethyl acrylate, hydroxypolyethoxyethyl methacrylate, acrylamide, vinyl heterocyclic monomers including 2-vinyl pyrrolidone, n-vinyl pyridine, vinyl epsilon caprolactam.

The polymers contained in the emulsion adhesives of this invention can contain about 0.1 to 50 wt-% of the alkylacrylamidoglycolate alkyl ether monomer in combination with a second polymerizable vinyl monomer comprising an alpha-olefin, vinyl chloride, vinylidine chloride, an aromatic monomer, an alpha, beta-unsaturated carboxylic acid monomer or amide or ester thereof, vinyl acetate or mixtures thereof.

An acrylic acid based copolymer can contain acrylic acid or methacrylic acid in combination with 0.1 to 50 wt-% of the alkylacrylamidoglycolate methyl ether monomer and optionally other monomers. A styrene based copolymer system can contain a styrenic monomer and 0.1 to 20 wt-% of the alkyl acrylamidoglycolate methyl ether monomer in combination with other monomers. A vinyl acetate based copolymer system can contain a vinyl acetate, 0.1 to 20 wt-% of the alkylacrylamidoglycolate methyl ether monomer, and optionally other monomers. An alpha-olefin based copolymer system can contain ethylene and 0.1 to 20 wt-% of the alkylacrylamidoglycolate alkyl ether monomer.

Preferred and most preferred emulsion adhesives comprise polymers containing the following constituents:

| Monomers | Preferred Mole % | Most Preferred Mole % |
|---|---|---|
| Styrene Systems | | |
| Styrene | 1–98 | 50–95 |
| Acrylate or methacrylate ester | 0–98 | 0–50 |
| Acrylic or methacrylic acid | 0–10 | 1–5 |
| Alkylacrylamidoglycolate alkyl ether monomer | 1–50 | 1–20 |
| Hydroxyethyl acrylate/acrylamide | 0–20 | 0–20 |

-continued

| Monomers | Preferred Mole % | Most Preferred Mole % |
|---|---|---|
| Vinyl Acetate System | | |
| Vinyl acetate | 50–99 | 50–95 |
| Acrylate or methacrylate ester | 0–50 | 0–50 |
| Acrylic or methacrylic acid | 0–10 | 0–5 |
| Alkylacrylamidoglycolate alkyl ether monomer | 1–50 | 1–20 |
| Hydroxyethyl acrylate/acrylamide | 0–20 | 1–20 |
| Alpha-Olefin Systems | | |
| Ethylene | 2–98 | 5–50 |
| Vinyl acetate | 0–98 | 1–75 |
| Acrylate or methacrylate ester | 0–50 | 0–50 |
| Acrylic or methacrylic acid | 0–10 | 0–5 |
| Alkylacrylamidogylcolate alkyl ether monomer | 1–50 | 1–20 |
| Acrylic Systems | | |
| Acrylic or methacrylic acid | 1–20 | 1–10 |
| Acrylate or methacrylate ester | 40–98 | 85–98 |
| Alkylacrylamidoglycolate alkyl ether monomer | 1–50 | 1–20 |
| Hydroxyethyl acrylate/acrylamide | 0–20 | 1–20 |

Polymerization

The aqueous emulsions containing the adhesive polymer of this invention are typically made using emulsion polymerization techniques modified for use in making polymers containing the alkyl acrylamidoglycolate alkyl ether containing copolymers of the invention. Most typical vinyl monomers are liquid in form and are easily suspended in aqueous reaction media when the emulsion polymerization mixture is formed. The solid alkyl acrylamidoglycolate alkyl ether requires that the monomer be dissolved in a monomer feed or added in portions in the solid form which can then be added throughout the emulsion polymerization. Typically the emulsion polymerizations are performed by adding to an emulsion polymerization reactor, a deionized water solution of an effective emulsion polymerization surfactant. Typically surfactants are used in such polymerization techniques to insure that the particle size of the monomer phase is controlled, resulting in a stable, effective emulsion formation. The reactor is typically heated to a polymerization reaction temperature between 30° and less than 100° C. The initial polymerization reaction mixture can contain optionally, molecular weight modifiers including alkylmercaptans, dialkylphthalates, triallyl cyanurates, and other well known molecular weight modifiers.

Into the heated aqueous mixture is added initial amounts of the polymerization initiator or catalyst or combinations thereof, and initial amounts of the monomer mixture. After polymerization is initiated the balance of the monomer mixture can be added in conjunction with additional amounts of catalyst. The reaction temperature is monitored to maintain a constant polymerization temperature. After the addition of the monomer catalyst is complete, additional treatments of the polymerization mixture can be made in order to ensure maximum conversion to polymer.

In the instance that they alkylacrylamidoglycolate alkyl ether compound is not soluble in the monomer mixture or other feed source, it can be typically added in solid form in small portions to the polymerization mixture during the polymerization reaction. Typically the monomer charge can be divided into from 5 to 15 portions and is added periodically on solid form in conjunction with catalyst and monomer mixture addition.

Typically the polymerization can be initiated by adding a small portion, typically 2 to 10% of the monomer mixture, and an optional amount, 2 to 10%, of the alkylacrylamidoglycolate alkyl ether portion with an initiator before monomer and catalyst addition begins. The above polymerization techniques can be modified by persons skilled in the art in order to optimize the polymerization.

Nonwoven fabrics that can be prepared using the emulsion adhesive compositions of the invention are made from fibers that include natural and synthetic fibrous materials. Natural fibers that can be bonded into nonwoven fabrics of the invention include jute, cotton, wool, cellulosic fibers, derived from pulp sources, flax, and others. Synthetic fibers that can be used in the nonwoven materials of this invention include polyolefin fibers such as polyethylene, polypropylene, poly-n-butylene, polyester materials, polyamide materials including polyarylamides, nylon, rayons, and others. The adhesives of this invention can be used to form nonwoven fabrics from virtually any other flexible fiber including glass fibers, graphite fibers, metal fibers, boron fibers, etc. The nonwoven fabrics can be made from blends of any of the above natural, synthetic or flexible fibrous materials. The adhesives of this invention can be optimized for use in forming bonded fiberglass containing nonwoven fabrics.

Formation of Nonwovens

The nonwoven fabrics of this invention are typically made by a process in which at least one loose feed web comprising an assembly of a fiber or mixtures of fibers is laid. The loose web, having little mechanical strength or stability, comprises randomly oriented fibrous materials. After the web or mat is formed, the web is typically fed by a conveyor past an adhesive applying station. Typically the aqueous emulsion adhesive of the invention is applied to at least one surface of the loose web. The adhesive is permitted to penetrate the fiber mass until substantial numbers of fibers are coated with sufficient adhesive to form fiber to fiber bonds in sufficient numbers to result in a stable fabric. The loose web is often treated with materials which permit a rapid penetration of the adhesive throughout the loose web. Optionally the web can be exposed to a source of a partial vacuum on a side opposite that of the adhesive spray. The vacuum tends to distribute the adhesive throughout the web. Optionally the treated web can be directed to a second station wherein the web can be treated with the adhesive emulsion of this invention on the opposite side of that first treated. At this second station the mat can also be treated with compositions which distribute the adhesive throughout the mat or can be exposed to the effects of a partial vacuum which also can disperse the adhesive throughout the web. The emulsion adhesive composition of the invention can also be applied to the fibers or to the web through polymer addition in the beater box, application using a foamer, a curtain coater, a spray gun, etc., at an add-on to the fibrous web of from about 1 to 30 wt-% solids, preferably 15 to 30 wt-% solids, and for reasons of economy most preferably 18 to 25 wt-% based on the weight of the fibrous web.

Typically after the adhesive has been applied and distributed throughout the web, the web is conveyed to a heating chamber for drying and a subsequent curing or crosslinking of the adhesive. Typically the drying-crosslinking step is done at an elevated temperature, approximately 200°–400° F. depending on the nature of the fiber web. Heat resistant materials such as fiberglass, arylamide and polyester fibers can be heated at high temperatures while heat sensitive fibers such as polyolefins, cotton and wool are heated to lower temperatures. The adhesive treated webs can be compressed during the curing step to form a fabric with a uniform thickness.

In a similar fashion a number of adhesive treated webs can be formed and combined under the effects of heat and pressure to form a multi-layered or laminated nonwoven fabric.

The above discussion provides a sufficient basis for understanding the invention. However, the following Examples further illustrate specific embodiments of the invention and include a best mode.

EXAMPLE I

A polymerization medium comprising 796 grams of deionized water, 5.46 grams of a sorbitan monolaurate surfactant, and 24.2 grams of a 40 wt-% active 4-vinyl benzene sulfonic acid were placed in a 2,000 milliliter round bottom glass flask equipped with a monomer feed addition dropping funnel, a second monomer feed addition dropping funnel, a catalyst feed addition dropping funnel, an electrically driven stirrer, a thermometer, and a reflux condenser. The reactor vessel was held in a water bath equipped with a stirrer, heater, and thermometer.

An initiator solution was prepared in a separate 100 milliliter glass beaker by combining 2.73 grams of sodium persulfate in 20 grams of deionized water. A monomer mixture was prepared by combining 259.6 grams of n-butyl acrylate, 190 grams of styrene and 10.38 grams of acrylic acid in a 1,000 milliliter glass beaker. A catalyst solution was prepared by combining 2.43 grams of 40 wt-% active 4-vinyl benzene sulfonic acid, 2.73 grams of sodium persulfate in 100 grams of water. An acrylamide monomer feed solution was prepared by combining 18.72 grams of acrylamide in 90 grams of deionized water.

Into the polymerization medium which was heated to a temperature of 80° C., was charged 4.12 grams of methylacrylamidoglycolate methyl ether and 5 volume-% of the monomer mixture. The reaction medium was stirred and the initiator solution was added. After a 15 minute hold, the balance of the monomer mixture, the acrylamide solution and the catalyst solution were added. The monomer mixture and the acrylamide solution were added over a 3 hour period. The catalyst solution was added over a 3½ hour period. Beginning with the additions above, 78.98 grams of methacrylamidoglycolate methyl ether monomer were added in 6.5 grams portions separated by 15 minute intervals.

The polymerization reaction temperature was maintained between 80° and 82° C. during the additions and for 15 minutes thereafter. The reaction mixture was permitted to cool and the finished polymer latex was stored.

EXAMPLES II–VII

Examples II through VII were prepared using the procedure of Example I exactly except that the following polymerization medium, initiator solution, monomer mixture, catalyst solutions as shown in the following Table were used:

TABLE 1

| | Examples | | | | | |
|---|---|---|---|---|---|---|
| | II | III | IV | V | VI | VII |
| Polymerization medium | | | | | | |
| 4-vinyl benzene sulfonic acid | 30.90 | 22.37 | 30.90 | 30.90 | 22.37 | 28.66 |
| Sorbitan monolaurate | 6.96 | 5.05 | 6.96 | 6.96 | 5.05 | 6.46 |
| Deionized water | 652.00 | 585.0 | 652.0 | 652.0 | 585.0 | 570.0 |
| Initiator | | | | | | |
| $Na_2S_2O_8$ | 3.47 | 2.52 | 3.47 | 3.47 | 2.52 | 3.24 |
| Deionized water | 25.80 | 18.5 | 25.80 | 25.80 | 18.50 | 22.0 |
| Monomer Mixture | | | | | | |
| n-butylacrylate | 215 | | 573 | 215 | 156 | 126.5 |
| Styrene | 358 | 334 | | | 260 | 484.4 |
| Acrylic acid | 13.22 | 9.59 | 10.38 | 10.38 | 9.59 | 12.29 |
| MAGME | 51.7 | 76.81 | 51.7 | 51.7 | 50.0 | 12.83 |
| Hydroxyethylacrylate | 51.7 | 80.0 | 51.7 | 51.7 | 25.0 | 12.83 |
| Methylmethacrylate | | | | 358.0 | | |
| Diallyl maleate | | | | | | 3.24 |
| t-dodecyl mercaptan | 0.64 | 0.47 | 0.51 | 0.51 | 0.47 | 0.61 |
| Catalyst | | | | | | |
| $Na_2S_2O_8$ | 3.47 | 2.52 | 3.47 | 3.47 | 2.52 | 3.24 |
| 4-vinyl-benzene sulfonic acid | 2.98 | 2.16 | 2.98 | 2.98 | 2.16 | 2.77 |
| Deionized water | 68.6 | 92.4 | 68.60 | 68.60 | 92.4 | 90.4 |

EXAMPLE VIII

Into a polymerization reaction vessel comprising a 2,000 milliliter round bottom flask equipped with a pre-emulsion monomer dropping funnel, a catalyst dropping funnel, a reflux condenser, thermometer, and stirrer was charged a polymerization medium comprising 10 grams of an alkoxylated alkyl phenol surfactant and 10 grams of siponate X-200 surfactant in 500 milliliters of deionized water.

In a separate 1,000 milliliter flask was prepared a pre-emulsion containing 130 grams of deionized water, 60 grams of IGEPAL CA-897 surfactant, 358 grams of styrene, 215 grams of n-butylacylate, 10.38 grams of acrylic acid, 51.7 grams of MAGME, 51.7 grams of 2-hydroxyethyl acrylate, and 0.51 grams of tertiary dodecyl mercaptan. In two separate 200 milliliter flasks were prepared an initial catalyst solution comprising 4 grams of potassium persulfate in 56 grams of deionized water and a delayed catalyst solution of 1.0 grams of potassium persulfate in 100 grams of deionized water.

The polymerization medium was heated to 80° C. and stirred. Five percent by volume of the pre-emulsion was added to the polymerization medium followed by the initiator solution. After a 15 minute period, the balance of the pre-emulsion mixture and the catalyst solution were added drop-wise, the pre-emulsion over 3 hours and the catalyst over 3½ hours. The polymerization reaction was maintained at 80° to 82° C. during the additions and for 45 minutes after the end of the catalyst feed. At the end of the reaction the mixture was cooled and stored.

EXAMPLE IX

Example VIII was repeated exactly except that 215 grams of 2-ethylhexyl acrylate were substituted for the 215 grams of n-butylacrylate and 20 grams of acrylamide was substituted for the 51.7 grams of 2-hydroxyethyl acrylate.

EXAMPLE X

Into a 2 liter round bottom reaction flask equipped with a monomer mix dropping funnel, a catalyst dropping funnel, reflux condenser, thermometer and stirrer was charged a polymerization medium comprising 680 grams of deionized water, 12.62 grams of ammonium hydroxide, 12.62 grams of acrylic acid, and 17.8 grams of a surfactant (SIPONATE X-200).

A monomer mixture was formed in a 1,000 milliliter Ehrlenmeyer flask by combining 464 grams of vinyl acetate, 102.4 grams of 2-hydroxyethyl acrylate, 102.4 grams of MAGME, and 0.4 grams of tertiary dodecyl mercaptan. An inital catalyst solution was formed in a 100 milliliter beaker by combining 3.56 grams of potassium persulfate and 40 grams of deionized water.

The polymerization medium was heated to a temperature between 80° and 85° F. followed by the addition of the initial catalyst and stirring was initiated. The monomer mixture was then added drop-wise over a 4-hour period. The drop-wise addition of a delayed catalyst solution of 3.56 g potassium persulfate in 40 g of water was started for 4½ hours. At the end of the addition the polymerization reaction was maintained at about 83° F. for 45 minutes. At the end of this period the mixture was cooled and stored.

EXAMPLE XI

In a 5 liter pressurized stainless steel reaction vessel was formed an initial polymerization medium comprising 620 grams of deionized water, 14.0 grams of IGEPAL CO-630 surfactant, 4 grams of sodium acetate, 0.5 grams of acetic acid, 400 grams of 10 wt-% active polyvinyl alcohol (VINOL 523), 200 grams of 20 wt-% active polyvinyl alcohol (VINOL 205), and 10 grams of a 1wt-% active solution of ammonium sulfate.

In a separate 2 liter Ehrlenmeyer flask, 70 grams of methacrylamidoglycolate methyl ether was dissolved in 1,305 grams of vinyl acetate. In a separate 200 milliliter beaker an initiator solution was prepared comprising 4 grams of ammonium persulfate in 96 grams of deionized water. In a separate 200 milliliter beaker a treatment solution was made comprising 1 gram of hydrosulfite AWC and 99 grams of deionized water.

The reaction vessel was purged with steam and the vinyl acetate MAGME solution was added to the polymerization medium. The polymerization solution was heated to 50° C. using steam jacket. The head space of the polymerization vessel was purged with nitrogen and ethylene was introduced into the reaction vessel at 500 psi. The catalyst and treatment solutions were added slowly over a 3 hour period. At the end of the addition the reaction temperature was increased to 80° C. for an additional 45 minutes. The reaction vessel pressure was released, purged with nitrogen and the thus-formed ethylene-vinyl acetate-MAGME copolymer was recovered and stored.

EXAMPLE XII

In the polymerization reaction vessel described in Example XI an initial polymerization medium comprising 510 grams of water, 91 grams of ABEX 185 surfactant, 12.7 grams of ABEX VA-50 surfactant, and 1.88 grams of sodium bicarbonate was formed.

In a separate 1,000 milliliter Ehrlenmeyer flask 52.77 grams of 2-hydroxyethyl acrylate and 31.48 grams of methylacrylamidoglycolate methyl ether were dissolved in 636.8 grams of vinyl acetate. An initial catalyst solution was prepared by adding to a 100 milliliter beaker 1.41 grams of sodium persulfate and 60 milliliters of water. An accelerator solution was prepared by dissolving 0.94 grams of hydrosulfite AWC and 14.07 grams of ABEX VA-50 in 65.67 grams of water. A catalyst solution was prepared in a 100 milliliter beaker by combining 1.69 grams of a 70 wt-% active tertiary butyl hydroperoxide solution in 65.67 grams of water.

10% of the monomer mixture was added to the reaction vessel at a temperature of 50° C. The initial catalyst solution was added to the reaction vessel and the mixture was held for 30 minutes. The reactor head space was purged with nitrogen and ethylene was introduced into the reaction mixture at a pressure of 500 psi. The catalyst solution, accelerator solution, and monomer solution were slowly added to the reaction mixture over a 4 hour period. The reaction temperature was increased to 80° C. for 45 minutes after completion of monomer addition. The reactor pressure was relieved and the reactor purged with nitrogen. The reactor was open and the thus-formed ethylene vinyl acetate hydroxyethyl acrylate MAGME copolymer was recovered and stored.

Preparation of Test Nonwoven Fibers From Fiberglass

For this purpose of testing the physical and chemical properties of nonwoven fabrics made using the adhesive of the Examples, fiberglass nonwoven fabrics were made using the following procedure. Glass fibers supplied from Owens-Corning, Johns Mannville, PPG, Certainteed, and other commercial sources, were dispersed in a white water solution comprising an approximately 1% solution of a thickener and a surfactant in water. A thickener was selected that effectively suspended the fibers throughout the aqueous solution and the surfactant aided in wetting the glass fibers. During the preparation of the nonwoven fabrics of this invention, the viscosity modifier or thickener was DOW AP-273 and the surfactant was KATAPOL VP-532. The glass fibers were dispersed throughout the white water at 0.14 parts of fiber per each 100 parts of water. The glass fibers measured approximately ½ to 1¼ inches in length. The dispersion was transferred to a Williams SHEET FORMER. The dispersion was distributed over the mesh with a mixer comprising a perforated blade equipped with a handle. After the glass fiber dispersion was uniformly distributed over the sheet forming screen, the white water was drained from below. The loosely formed web was removed from the screen and applied to a second screen. The emulsion polymer adhesive of this invention was applied to the loose web by saturating the web with droplets of the polymer emulsion. Partial vacuum was applied to the screen side of the fiber web to remove excess aqueous adhesive. The web was removed from the screen, placed in a Blue M® forced air oven and was cured at a temperature between 160° and 210° C. for 1 to 2 minutes. The cured nonwoven fabric was then tested for its physical and chemical properties.

TABLE 2

Properties of Nonwoven Fiberglass Fabrics Made with Adhesives of the Examples

| Ex. # | Dry Tensile* | Wet Tensile* | Hot Tensile** (350° F.) | Tear Strength | Loss on Ignition (%) |
|---|---|---|---|---|---|
| I | 34.5 | 21.6 | 27.6 | 591 | 22.9 |
| III | 19.0 | 18.6 | 14.5 | 610 | 20.7 |
| IV | 26.3 | 15.9 | 17.8 | 921 | 38.5 |
| V | 44.8 | 31.3 | 13.9 | 381 | 26.6 |
| VI | 34.2 | 23.6 | 17.6 | 367 | 29.8 |
| VIII | 47.3 | 40.0 | 10.8 | 441 | 26.4 |
| XI | 41.3 | 38.5 | 11.4 | 569 | 28.7 |

*pounds per inch (width)
**pounds per 2-inch strip (width)

The test results shown above were produced using ARMA 4-82 test procedure for tensile strength and ARMA 5-82 for tear strength.

The above test results demonstrate that the adhesives of this invention can be used to manufacture high quality nonwoven fabrics.

The specification, Examples and data shown above provide a basis for understanding and using the invention. However since many embodiments of the invention can be made without departing from the spirit and scope of the invention, the invention resides in the claims hereinafter appended.

We claim:

1. A nonwoven fabric comprising an adhesively bonded assembly made of at least one web of loosely assembled randomly arranged nonwoven fibers using a bonding adhesive which comprises, in an aqueous emulsion, a polymer derived from:

(a) about 2 to 98 wt-% of a vinyl monomer;

(b) about 0.1 to 50 wt-% of an alkylacryl amido glycolate alkyl ether of the formula

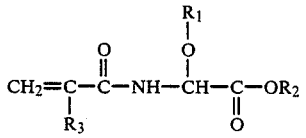

wherein $R_1$ and $R_2$ are independently $C_{1-6}$ alkyl or cycloalkyl and $R_3$ is hydrogen or methyl; and (c) about 0.1 to 20 wt-% of a vinyl monomer having a free crosslinking reactive hydrogen in the form of a hydroxyl group, and amino group, or mixtures of such vinyl monomers;

wherein the amount of each monomer is based on the total polymer weight.

2. The adhesive of claim 1 wherein the alkylacrylamidoglycolate alkyl ether comprises methylacrylamidoglycolate methyl ether.

3. The fabric of claim 2 wherein the ratio of the methylacrylamido glycolate methyl ether monomer to the vinyl monomer is about 0.05 to 5 parts of methylacrylamidoglycolate methyl ether per each 10 parts of vinyl monomer.

4. The fabric of claim 3 wherein the adhesive additionally comprises a vinyl aromatic monomer which is present in the polymer at a concentration of about 15 to 95% by weight.

5. The fabric of claim 4 wherein the vinyl aromatic monomer is styrene.

6. The fabric of claim 1 wherein the vinyl monomer comprises an alpha, beta-unsaturated acid, a $C_{1-5}$ alkyl ester thereof or mixtures thereof.

7. The fabric of claim 6 wherein the alpha, beta-unsaturated acid comprises acrylic acid, methacrylic acid or mixtures thereof.

8. The fabric of claim 6 wherein the alkyl ester of the alpha, beta-unsaturated carboxylic acid compound comprises a $C_{1-5}$ alkyl acrylate or a $C_{1-5}$ alkyl methacrylate which is present in the polymer at a concentration of about 40–60 wt-%.

9. The fabric of claim 7 wherein the mixture of alpha, beta-unsaturated carboxylic acid and the alkyl ester of the alpha, beta-unsaturated carboxylic acid in part (b) comprises about 0.1 to 10 wt-% of acrylic acid and 40 to 60 wt-% of n-butyl acrylate, the percentages based on the total polymer weight.

10. The fabric of claim 1 wherein the vinyl monomer with a free crosslinking reacting hydrogen in the form of an amino group is present at a concentration of about 1 to 15 wt-%.

11. The fabric of claim 10 wherein the vinyl monomer comprises acrylamide, which is present in the polymer at a concentration of about 2 to 10 wt-%.

12. The fabric of claim 11 wherein the vinyl monomer with a free crosslinking reactive hydrogen in the form of a hydroxyl group comprises a hydroxyalkyl acrylate, a hydroxyalkyl methacrylate, or mixtures thereof.

13. The fabric of claim 7 wherein the vinyl monomer comprises hydroxyethyl acrylate, which is present in the polymer at a concentration of about 0.2 to 20 wt-%.

* * * * *